US010135128B2

(12) United States Patent
Oh et al.

(10) Patent No.: US 10,135,128 B2
(45) Date of Patent: Nov. 20, 2018

(54) ANTENNA MODULE

(71) Applicant: LG INNOTEK CO., LTD., Seoul (KR)

(72) Inventors: Sang Bae Oh, Seoul (KR); In Pyo Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 40 days.

(21) Appl. No.: 15/137,479

(22) Filed: Apr. 25, 2016

(65) Prior Publication Data

US 2016/0315390 A1 Oct. 27, 2016

(30) Foreign Application Priority Data

Apr. 24, 2015 (KR) ..... 10-2015-0057841

(51) Int. Cl.

| | |
|---|---|
| ***H01Q 1/22*** | (2006.01) |
| ***H01Q 5/328*** | (2015.01) |
| ***H01Q 1/36*** | (2006.01) |
| ***H01Q 1/38*** | (2006.01) |
| ***H01Q 9/42*** | (2006.01) |

(52) U.S. Cl.

CPC ..... *H01Q 1/36* (2013.01); *H01Q 1/38* (2013.01); *H01Q 9/42* (2013.01); *H01Q 1/2291* (2013.01); *H01Q 5/328* (2015.01)

(58) Field of Classification Search

CPC ..... H01Q 1/2291; H01Q 1/36; H01Q 1/38; H01Q 9/42; H01Q 5/30; H01Q 5/307; H01Q 5/314; H01Q 5/328; H01Q 5/378; H01Q 1/2258; H01Q 1/2266; H01Q 1/2275; H01Q 1/24; H01Q 1/241; H01Q 1/242; H01Q 1/243; H01Q 9/0414; H01Q 5/392; H01Q 5/385; H01Q 1/48; H01Q 9/04; H01Q 9/0407; H01Q 9/0442

See application file for complete search history.

(56) References Cited

U.S. PATENT DOCUMENTS

| | | | | |
|---|---|---|---|---|
| 7,209,081 | B2 * | 4/2007 | Chang | H01Q 1/38 343/700 MS |
| 8,405,552 | B2 * | 3/2013 | Bae | H01Q 1/2208 343/700 MS |
| 8,854,268 | B2 * | 10/2014 | Lin | H01Q 1/2266 343/702 |
| 2001/0043159 | A1 * | 11/2001 | Masuda | H01Q 1/38 343/700 MS |

* cited by examiner

*Primary Examiner* — Tho G Phan
*Assistant Examiner* — Patrick Holecek
(74) *Attorney, Agent, or Firm* — Saliwanchik, Lloyd & Eisenschenk

(57) ABSTRACT

An antenna module is provided. The antenna module according to one embodiment of the present invention includes a ground portion which has a lower ground plane, a dielectric layer disposed on the lower ground plane, and an upper ground plane disposed on the dielectric layer, and an antenna portion disposed at an adjoining surface of the ground portion and configured to have a patch layer, a dielectric layer disposed on the patch layer, and an antenna layer disposed on the dielectric layer, and having a plurality of unit patterns which continuously repeat.

9 Claims, 15 Drawing Sheets

PRIOR ART

PRIOR ART

ANTENNA MODULE

CROSS-REFERENCE TO RELATED APPLICATION

This application claims priority under 35 U.S.C. § 119 to Korean Patent Application No. 2015-0057841, filed Apr. 24, 2015, which is hereby incorporated by reference in its entirety.

BACKGROUND

Field of the Invention

The present invention relates to an antenna module, and more particularly, to an antenna module applicable to an Industry-Science-Medical (ISM) band.

Discussion of Related Art

An Industry-Science-Medical (ISM) band is a frequency band designated for radio frequency energy use in industrial, scientific, and medical fields rather than telecommunications. According to the trends of miniaturization and lightening of electronic devices, an antenna module embedded in an electronic device using the ISM band needs to be designed to a small-size.

FIG. 1 illustrates an example of a Meander type Planar inverted-F Antenna (PIFA) antenna for the ISM band, and FIG. 2 is an example of a Monopole type antenna for the ISM band. The size of the Meander type antenna is about 27 mm by 17 mm, and the size of the monopole type antenna is about 26 mm by 19 mm. Since both the two cases illustrated require a wiring space for an antenna length corresponding to a wavelength of $\lambda/4$ to secure a resonant frequency required for 2.4 GHz of the ISM band, there is a limit in reducing the size of the antenna.

In addition, in the case of a Bluetooth Low Energy (BLE) antenna for the ISM band, the size may be reduced down to 20 mm by 11 mm through a design which utilizes a bottom surface to secure a required length of the antenna, but a problem occurs in which a frequency deviation is influenced by permittivity.

BRIEF SUMMARY

The present invention relates to a small-sized antenna module applicable to an Industry-Science-Medical (ISM) band.

One aspect of the present invention provides an antenna module including: a ground portion having a lower ground plane, a dielectric layer disposed on the lower ground plane, and an upper ground plane disposed on the dielectric layer; and an antenna portion disposed at an adjoining surface of the ground portion, and configured to have a patch layer, a dielectric layer disposed on the patch layer, and an antenna layer disposed on the dielectric layer and having a plurality of unit patterns which continuously repeat.

The patch layer and the lower ground plane may be connected to each other.

The patch layer and the lower ground plane may be electrically connected to each other.

The patch layer and the lower ground plane may be electrically connected to each other through a via.

A frequency may be configured to vary depending on connecting positions of the patch layer with the lower ground plane.

The ground portion may be coupled to the antenna portion by capacitive coupling.

The antenna layer may be connected to the ground portion.

The antenna module may further include a feed line branched off from one end extending from a plurality of unit patterns and connected to the ground portion, a signal line branched off from the one end extending from the plurality of unit patterns and connected to the ground portion, and a dead-end extending from the plurality of unit patterns to radiate a frequency signal.

The plurality of unit patterns may be formed between the feed line and the dead-end.

The shape of the dead-end may include a Hilbert curve.

An inductive loading may be caused by the antenna layer.

The plurality of unit patterns may include a Hilbert curve structure.

Another aspect of the present invention provides an antenna module including: a dielectric layer; a ground plane disposed on the dielectric layer; and an antenna layer disposed on the dielectric layer and formed at an adjoining surface of the ground plane, wherein the antenna layer includes a feed line connected to the ground plane, an inductive loading area connected to the feed line, and a dead-end extending from the inductive loading area to radiate a frequency signal.

The inductive loading area may be wired by a plurality of unit patterns which continuously repeat.

The plurality of unit patterns may include a Hilbert curve structure.

The inductive loading area may be disposed between the feed line and the dead-end.

BRIEF DESCRIPTION OF THE DRAWINGS

The above and other objects, features and advantages of the present invention will become more apparent to those of ordinary skill in the art by describing exemplary embodiments thereof in detail with reference to the attached drawings, in which.

DETAILED DESCRIPTION

Figure 1:
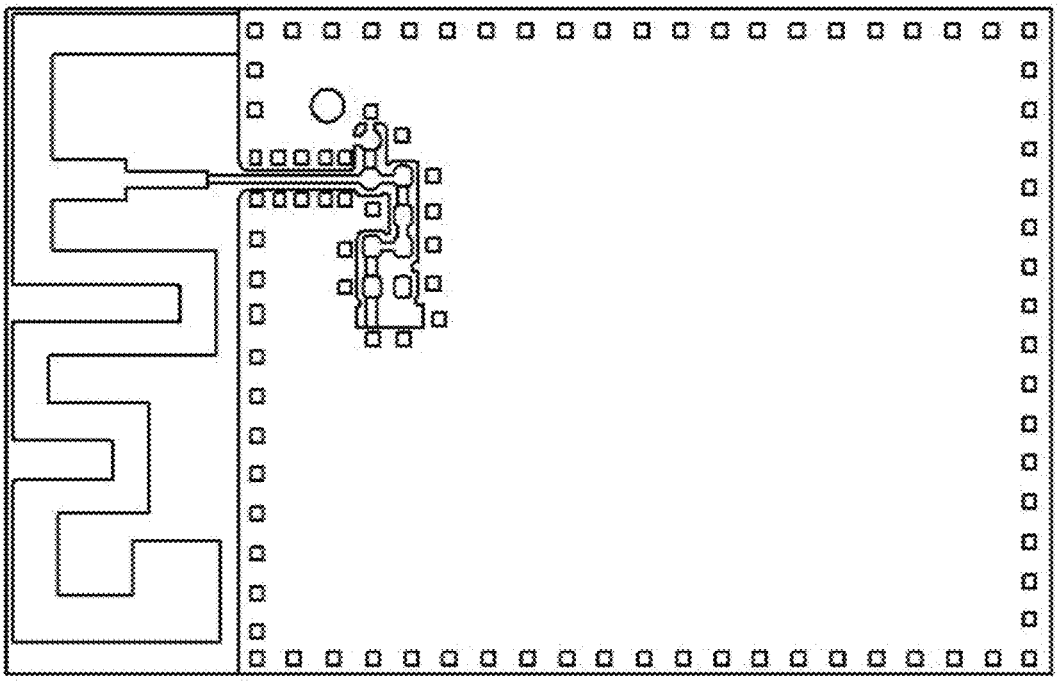
FIG. 1 is an example view of a meander type Planar Inverted-F Antenna (PIFA) for an Industry-Science-Medical (ISM) band.
Figure 2:
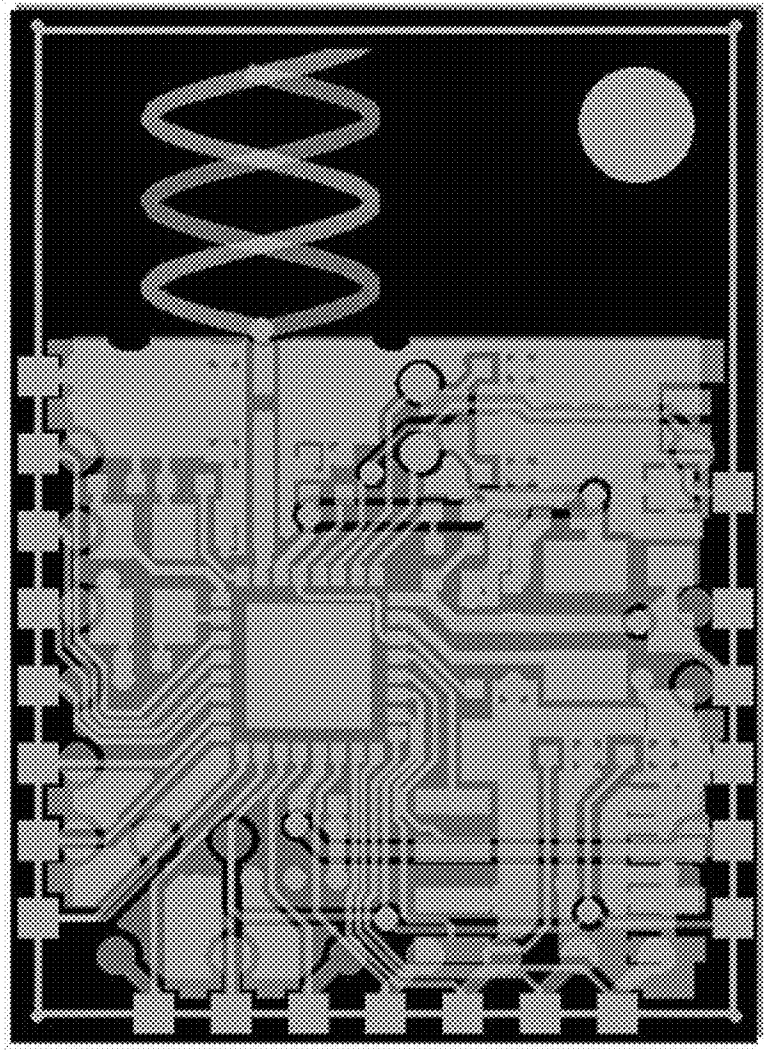
FIG. 2 is an example view of a Monopole type antenna for the ISM band.

As the present invention is amenable to various modifications and alternative forms of embodiments, a certain particular embodiment will be described in connection with drawings. It should be understood, however, that the intention is not to limit the invention to the particular embodiments described. The intention is to cover all modifications, equivalents, and alternatives falling within the technical spirit and scope of the invention.

Although the terms first, second, etc. may be used to describe various elements, these elements are not limited by these terms. These terms are only used to distinguish one element from another. For example, a first element could be termed a second element, and, similarly, a second element could be termed a first element, without departing from the scope of exemplary embodiments. The term "and/or" includes any and all combinations of one or more of the associated listed items.

It should be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present.

The terminology used herein to describe embodiments of the invention is not intended to limit the scope of the inventive concept. As used herein, the singular forms "a," "an," and "the" are intended to include the plural forms as well, unless the context clearly indicates otherwise. It should be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which this inventive concept belongs. It should be further understood that terms, such as those defined in commonly used dictionaries, should be interpreted as having meanings that are consistent with their meaning in the context of the relevant art and are not to be interpreted in an idealized or overly formal sense unless expressly so defined herein.

Hereinafter, embodiments of the present invention will be described in detail with reference to the accompanying drawings. In the description with reference to the accompanying drawings, like elements are designated by the same reference numerals regardless of drawing numbers, and duplicated descriptions thereof will be omitted.

Figure 3:
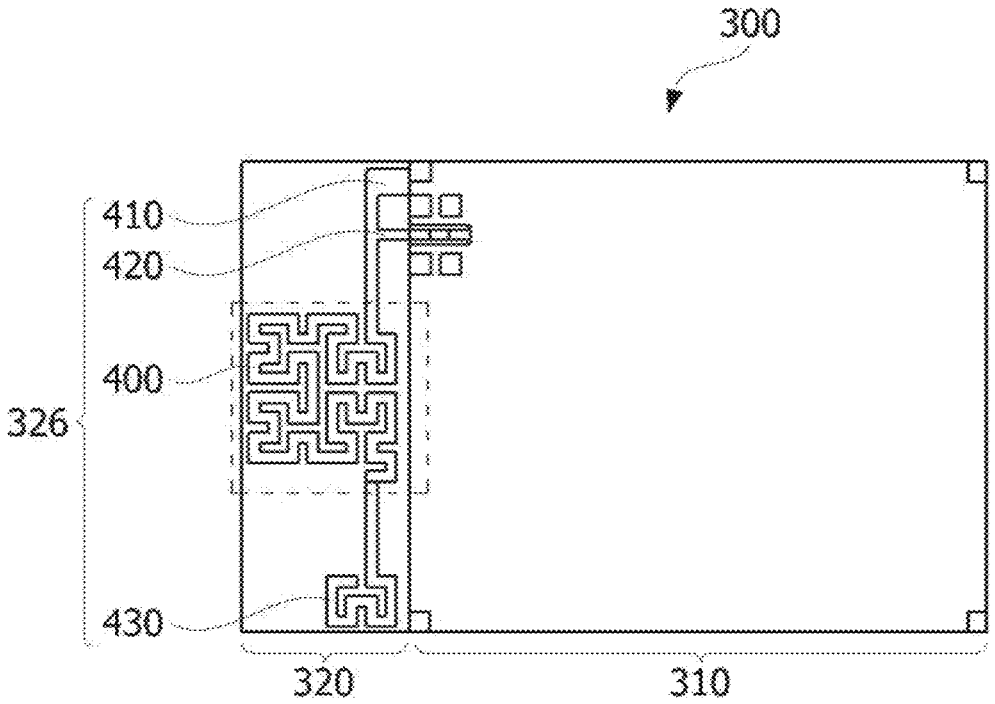
FIG. 3 is a top view of an antenna module according to one embodiment of the present invention.
Figure 4:
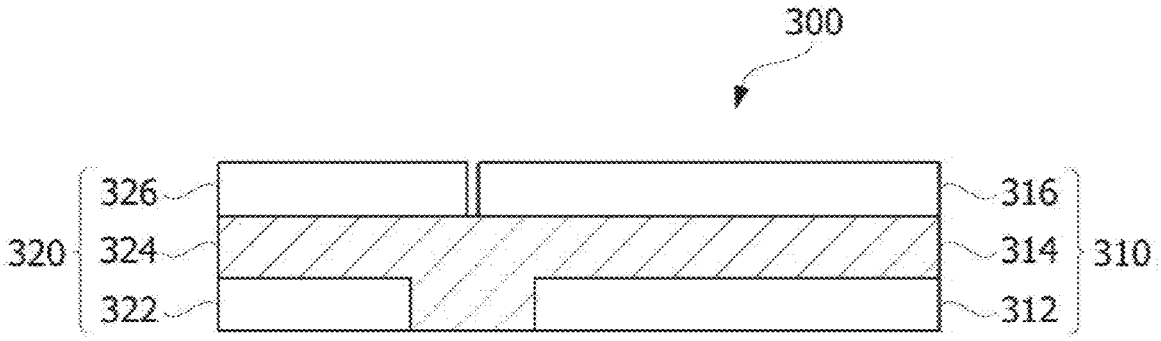
FIG. 4 is a side view of the antenna module according to one embodiment of the present invention.

FIG. 3 is a top view of an antenna module according to one embodiment of the present invention, and FIG. 4 is cross-sectional view of the antenna module according to one embodiment of the present invention.

Figure 19:
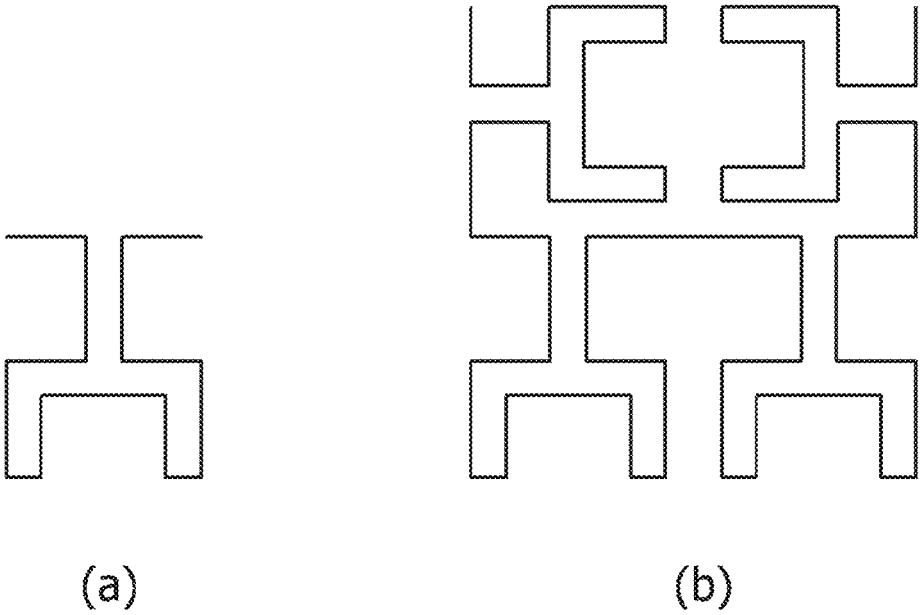
FIG. 19 illustrates an example of a Hilbert curve.

Referring to FIGS. 3 and 4, an antenna module 300 includes aground portion 310 and an antenna portion 320. The ground portion 310 includes a lower ground plane 312, a dielectric layer 314 disposed on the lower ground plane 312, and an upper ground plane 316 disposed on the dielectric layer 314. Although not shown, various electronic components such as a chip may be mounted on the upper ground plane 316. Here, the lower ground plane 312 and the upper ground plane 316 may be a metal layer having electrical conductivity, for instance a metal layer including copper (Cu). In addition, the antenna portion 320 is disposed at an adjoining surface of the ground portion 310, and includes a patch layer 322, a dielectric layer 324 disposed on the patch layer 322, and an antenna layer 326 disposed on the dielectric layer 324. Here, the patch layer 322 may be a metal layer having electrical conductivity, for instance a metal layer including copper (Cu). In addition, the antenna layer 326 may include a plurality of unit patterns 400 which continuously repeat. The unit pattern may be, for instance, a structure of a Hilbert curve. The Hilbert curve will be illustrated in FIG. 19. In the present specification, The Hilbert curve structure and a Hilbert curve fractal structure may be used interchangeably. Further, the antenna layer 326 includes a feed line 410 which is branched off from one end which extends from the plurality of unit patterns 400 and which is connected to the ground portion 310, a signal line 420 which is branched off from the one end which extends from the plurality of unit patterns 400 and which is connected to the ground portion 310, and a dead-end 430 which extends from the plurality of unit patterns 400 to radiate a frequency signal. A shape of the dead-end 430 may be the Hilbert curve structure or at least a portion of the Hilbert curve structure. Therefore, frequency radiation efficiency of the dead-end 430 may be increased.

Here, the plurality of unit patterns 400 may be formed between the feed line 410 and the dead-end 430. Preferably, the plurality of unit patterns 400 may be formed at the central area between the feed line 410 and the dead-end 430. As described above, when the antenna layer 326 has the plurality of unit patterns, for instance, when a Hilbert curve fractal structure 400 serving as the plurality of unit patterns is formed between the feed line 410 and the dead-end 430, an entire length of wiring to be accommodated in a fixed space is increased, and then the length in which a current flows becomes longer, which may serve as inductive loading. Accordingly, the plurality of unit patterns 400 and an inductive loading area may be used interchangeably. In addition, when the antenna layer 326 has the plurality of unit patterns, for example, the Hilbert curve fractal structure, an inductance value may be quantitatively predictable because the unit pattern is repeated several times.

Meanwhile, the dielectric layer 314 and the dielectric layer 324 are an integrated dielectric layer structure coupled to each other and may include a dielectric material such as fiberglass (FR), glass epoxy, or the like.

Hereinafter, a simulation result and a manufacturing result of an antenna module according to one embodiment of the present invention will be described.

Figure 5:
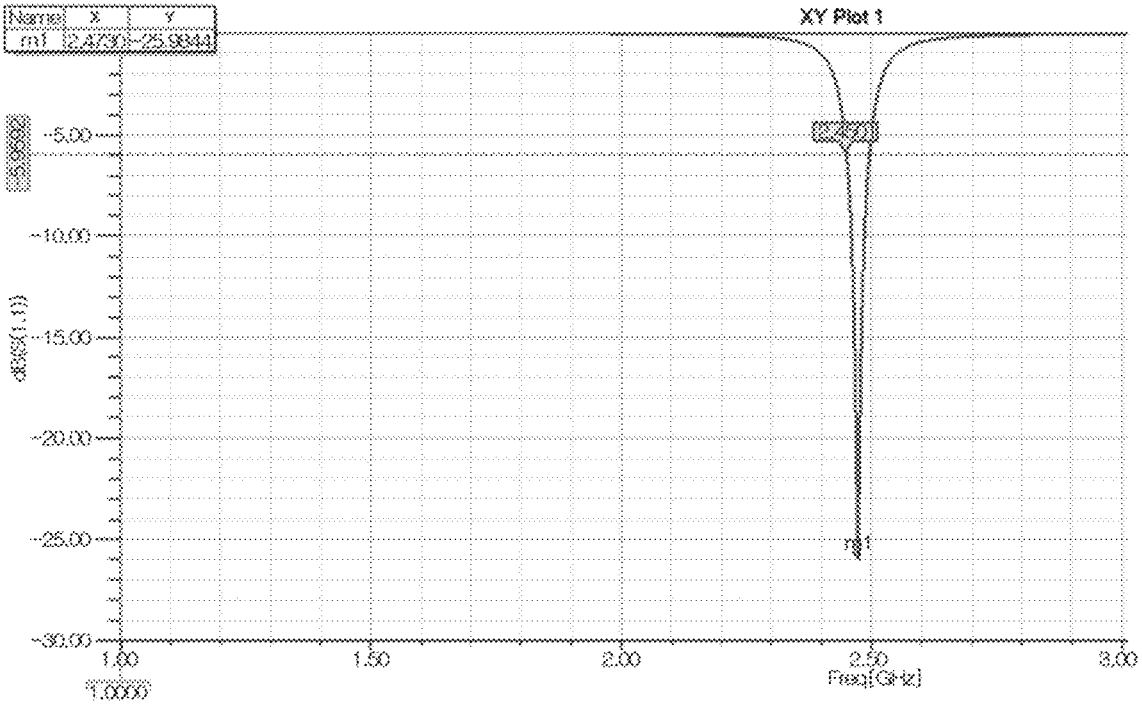
FIG. 5 illustrates S11 simulation results of the antenna module according to one embodiment of the present invention.
Figure 6:
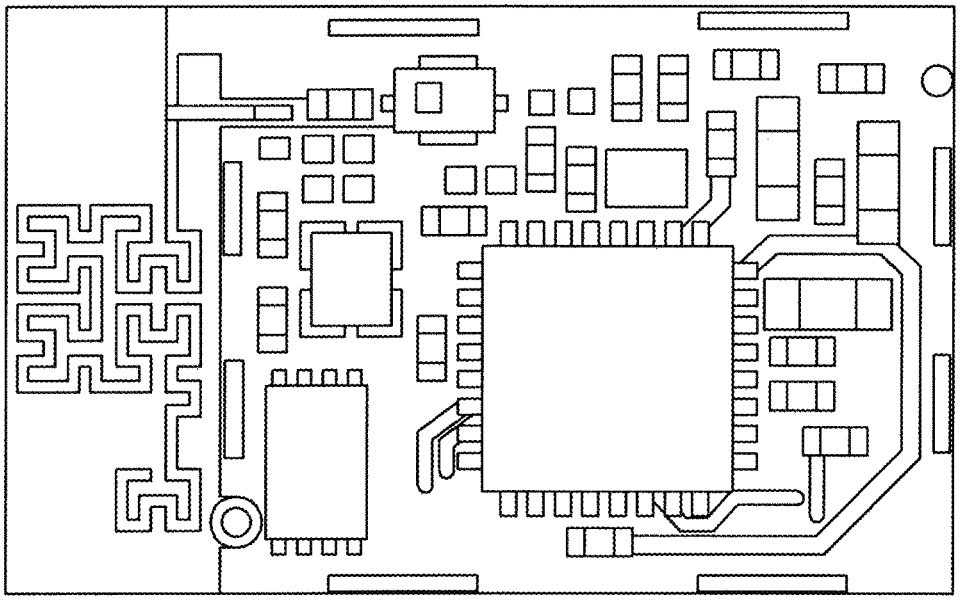
FIG. 6 illustrates an antenna module manufactured according to one embodiment of the present invention.
Figure 7:
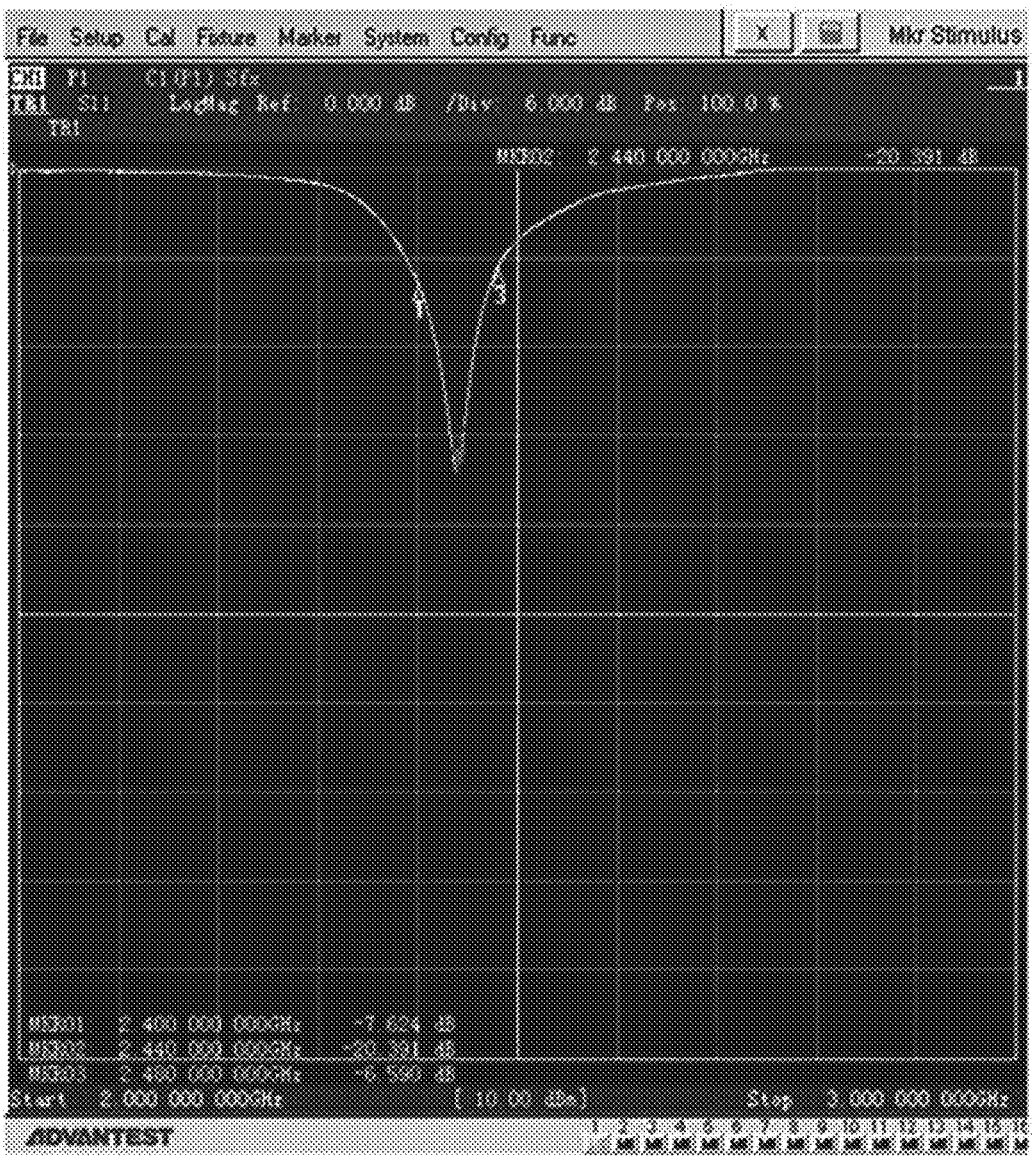
FIGS. 7 and 8 illustrate S11 measurement results of the antenna of FIG. 6.
Figure 8:
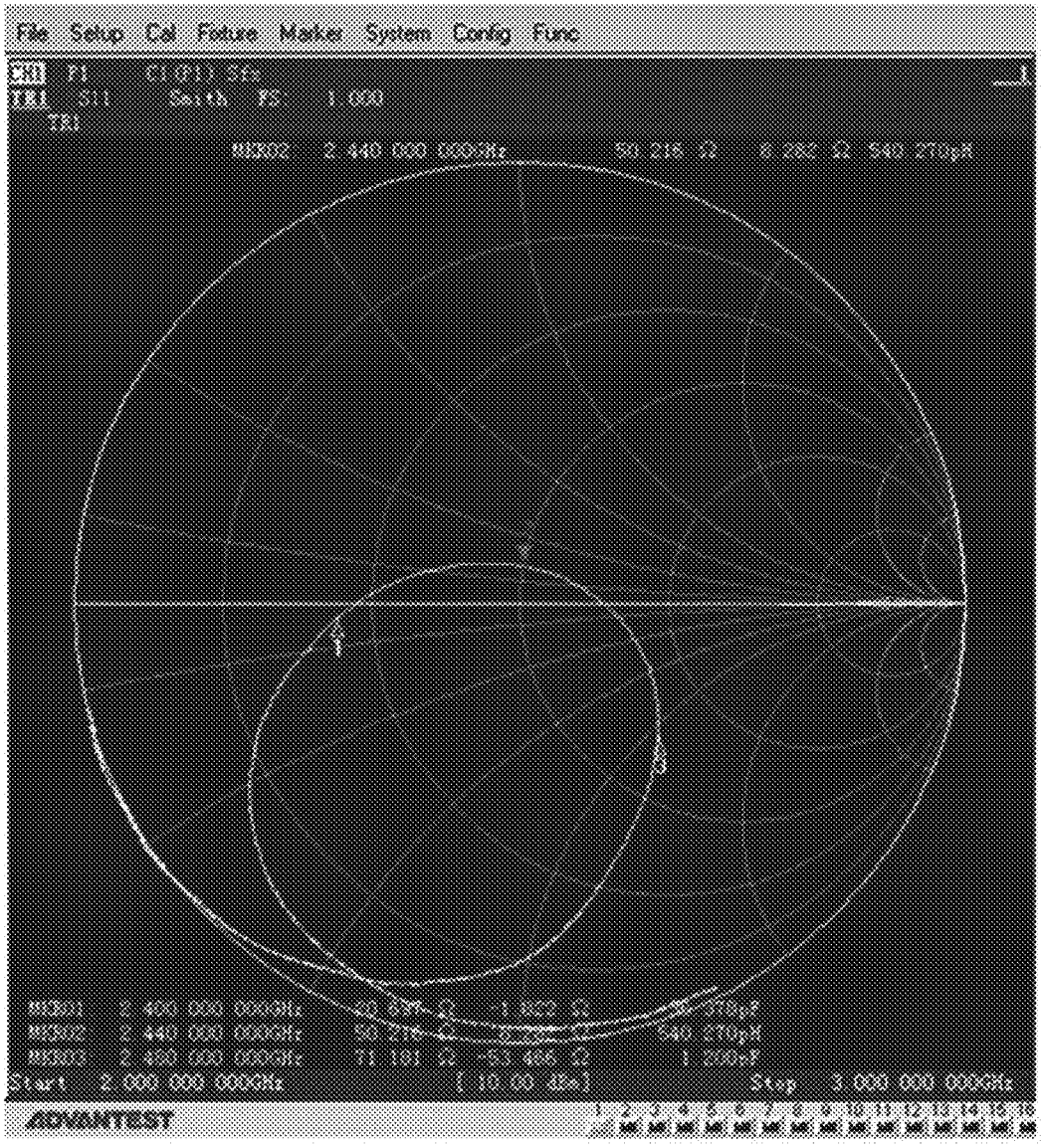
Figure 9:
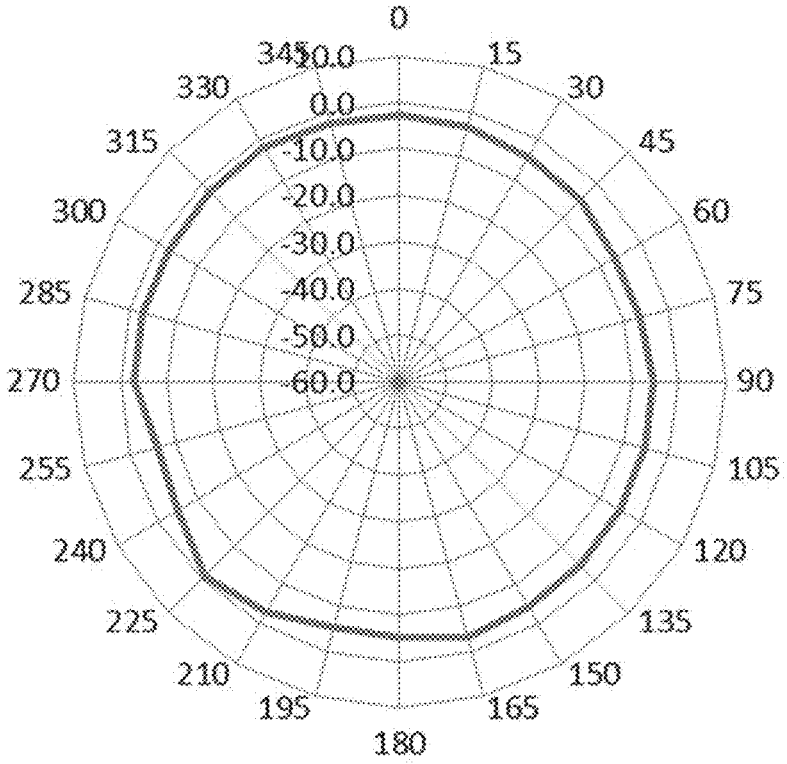
FIGS. 9 to 11 illustrate actually measured results of a two-dimensional radiation pattern of the antenna module of FIG. 6.
Figure 10:
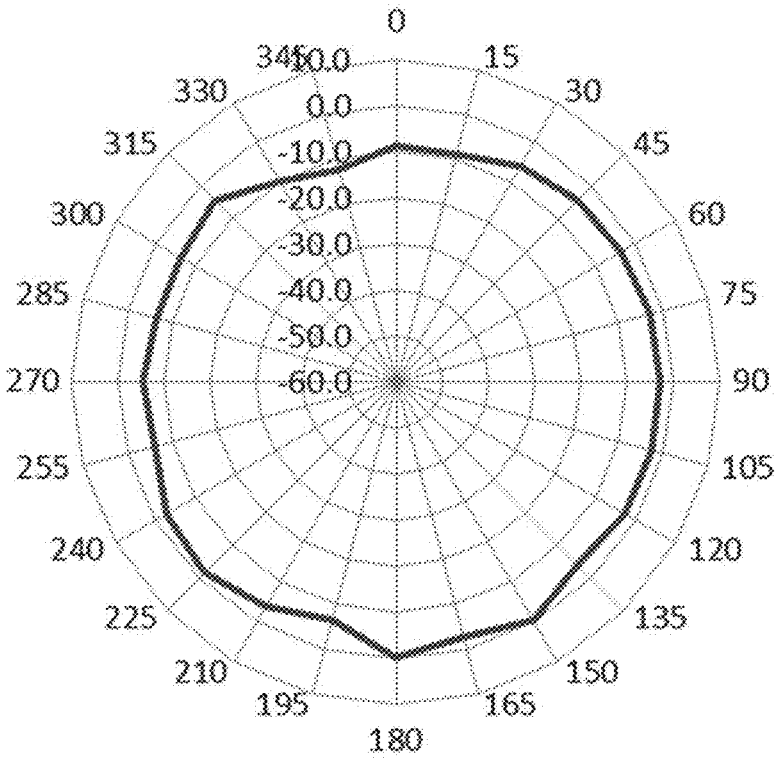
Figure 11:
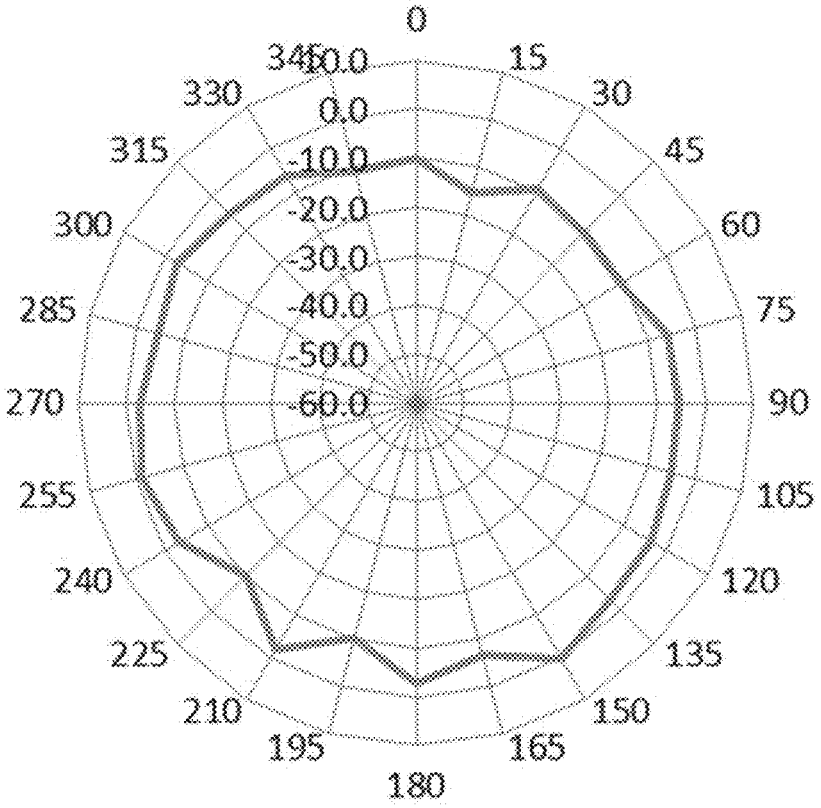
Figure 12:
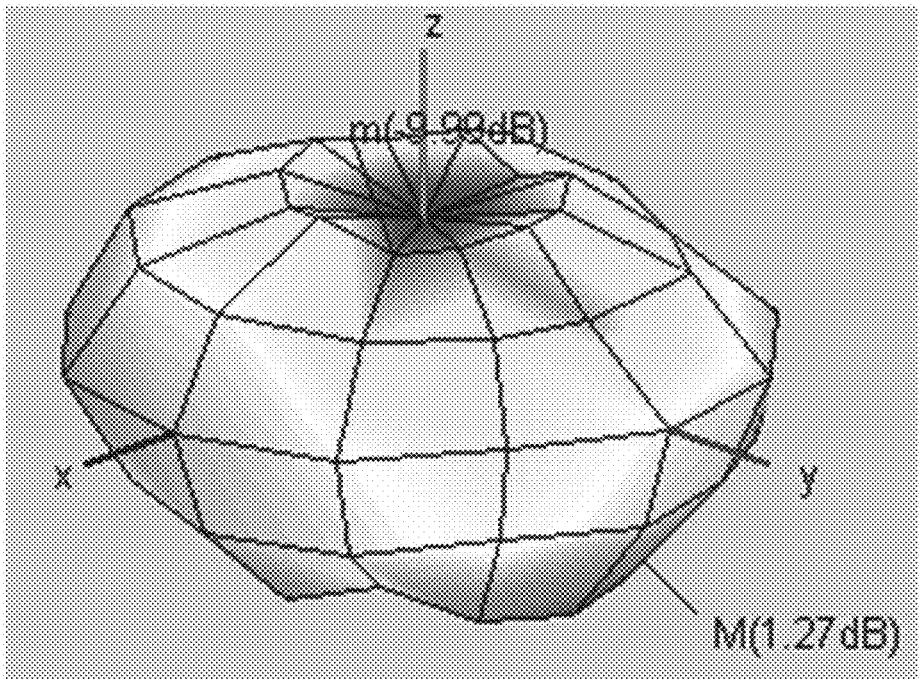
FIG. 12 illustrates an actually measured results of a three-dimensional radiation pattern of the antenna module of FIG. 6.
Figure 13:
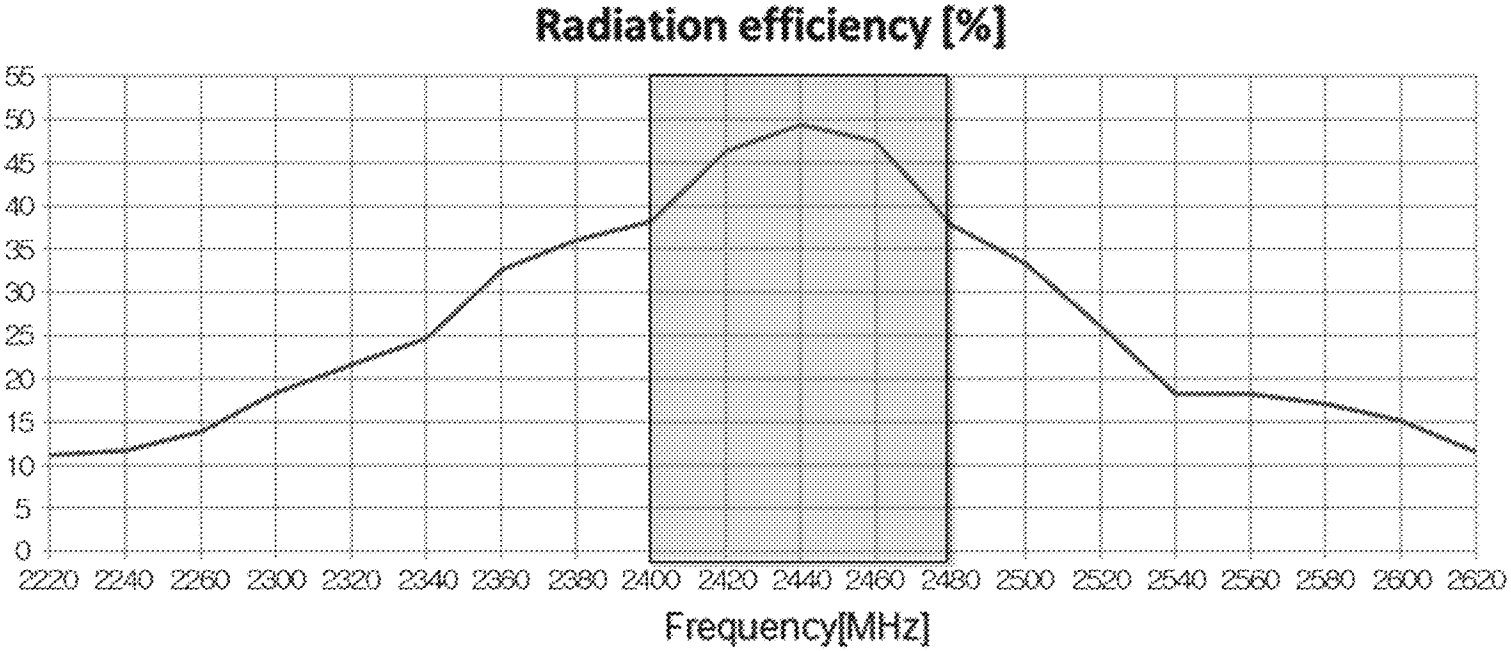
FIG. 13 illustrates a radiation efficiency of the antenna module of FIG. 6.

FIG. 5 illustrates S11 simulation results of the antenna module according to one embodiment of the present invention. FIG. 6 illustrates an antenna module manufactured according to one embodiment of the present invention, and FIGS. 7 and 8 illustrate S11 measurement results of the antenna module of FIG. 6. In addition, FIG. 9 illustrates an actually measured result of an XY two-dimensional radiation pattern of the antenna module of FIG. 6, FIG. 10 illustrates an actually measured result of an XZ two-dimensional radiation pattern of the antenna module of FIG. 6, FIG. 11 illustrates an actually measured result of a YZ two-dimensional radiation pattern of the antenna module of FIG. 6, and FIG. 12 illustrates an actually measured result of a three-dimensional radiation pattern of the antenna module of FIG. 6. In addition, FIG. 13 illustrates radiation efficiency of the antenna module of FIG. 6, and Table 1-1 and Table 1-2 illustrate three-dimensional radiation efficiency and peak gain. Here, S11 means return loss.

TABLE 1-1

| | Frequency (MHz) | | | | | | | | | |
|---|---|---|---|---|---|---|---|---|---|---|
| | 2220 | 2240 | 2260 | 2300 | 2320 | 2340 | 2360 | 2380 | 2400 | 2420 |
| Efficiency (dB) | −9.53 | −9.34 | −8.59 | −7.34 | −6.65 | −6.08 | −4.88 | −4.44 | −4.18 | −3.34 |
| Efficiency (%) | 11.15 | 11.63 | 13.84 | 18.45 | 21.65 | 24.66 | 32.49 | 35.98 | 38.22 | 46.37 |
| Peak Gain (dB) | −5.50 | −5.01 | −3.99 | −2.84 | −2.22 | −1.70 | −.069 | −0.18 | 0.13 | 1.04 |

TABLE 1-2

| | Frequency (MHz) | | | | | | | | | |
|---|---|---|---|---|---|---|---|---|---|---|
| | 2440 | 2460 | 2480 | 2500 | 2520 | 2540 | 2560 | 2580 | 2600 | 2620 |
| Efficiency (dB) | −3.06 | −3.23 | −4.22 | −4.77 | −5.84 | −7.38 | −7.38 | −7.67 | −8.19 | −9.39 |
| Efficiency (%) | 49.47 | 47.53 | 37.88 | 33.32 | 26.06 | 18.28 | 18.30 | 17.09 | 15.18 | 11.52 |
| Peak Gain (dB) | 1.27 | 1.02 | −0.08 | −0.77 | −1.82 | −3.13 | −3.15 | −3.55 | −4.14 | −5.41 |

Referring to FIGS. 5, 7 and 8, a reflectivity S (1, 1) at around 2.4 GHz of an Industry-Science-Medical (ISM) band can be seen to be −25 dB or less.

In addition, referring to FIGS. 9 to 12, an average gain of a radiation pattern of the XY plane at the 2.44 GHz frequency band is −3.77 dB, an average gain of a radiation pattern of the XZ plane is −3.97 dB, and an average gain of a radiation pattern of the YZ plane is −4.85 dB, from which it can be seen that the antenna module according to one embodiment of the present invention has an omnidirectional characteristic.

In addition, referring to FIG. 13 and Table 1, it can be seen that the radiation efficiency of a receiving side of the antenna module according to one embodiment of the present invention is high in the range of 2.4 GHz to 2.48 GHz of the ISM band.

Figure 14:
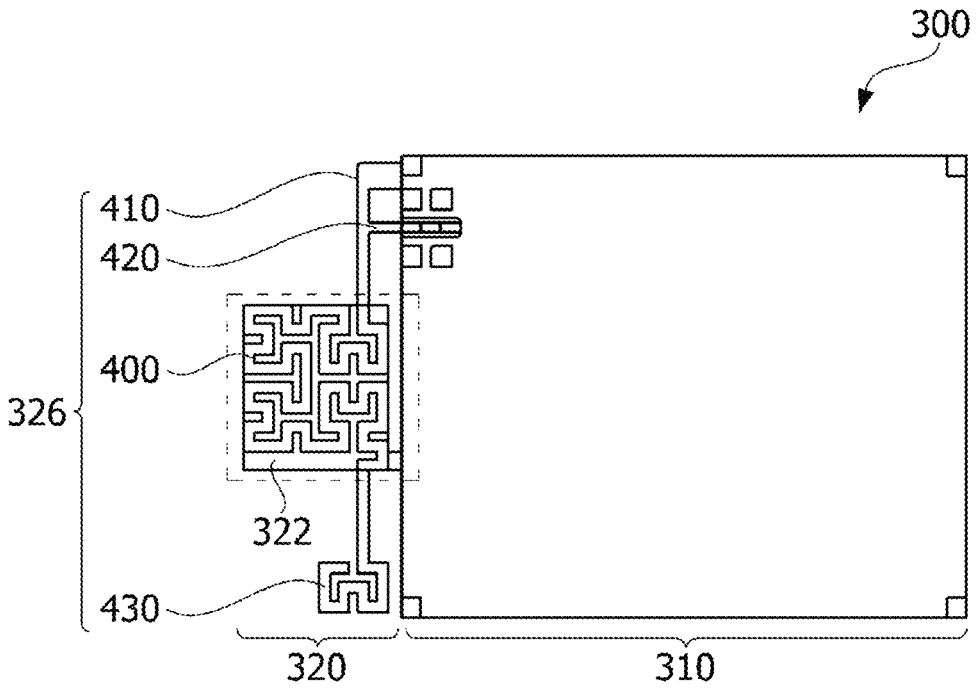
FIG. 14 is a top view of an antenna module according to another embodiment of the present invention.
Figure 15:
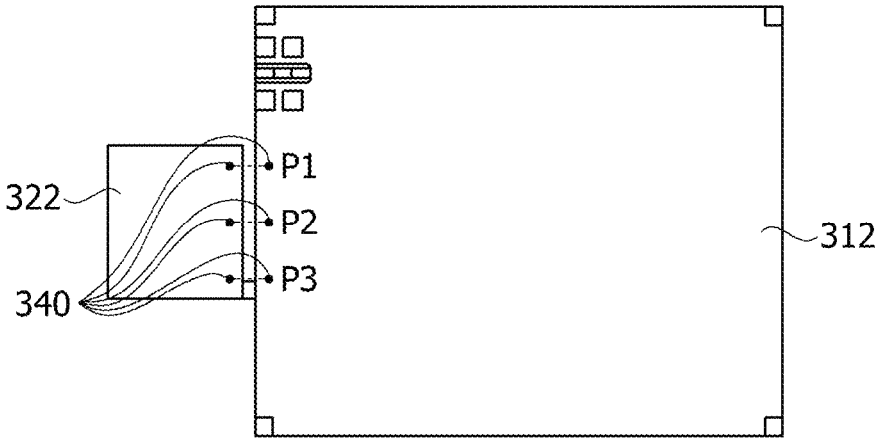
FIG. 15 is a bottom view of the antenna module according to another embodiment of the present invention.
Figure 16:
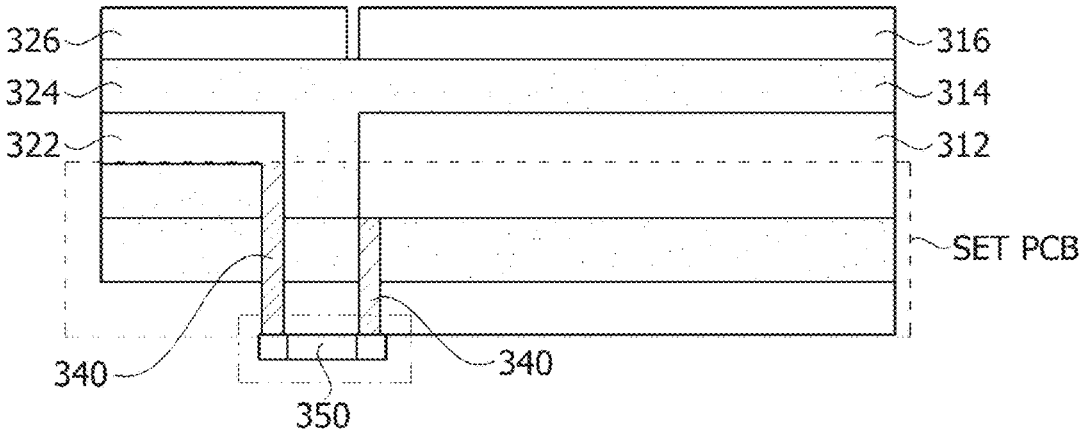
FIG. 16 is a side view of the antenna module according to another embodiment of the present invention.

FIG. 14 is a top view of an antenna module according to another embodiment of the present invention, FIG. 15 is a bottom view of the antenna module according to another embodiment of the present invention, and FIG. 16 is a cross-sectional view of the antenna module according to another embodiment of the present invention. For convenience of description, a dielectric layer is omitted in the illustrations of FIGS. 14 and 15. Descriptions duplicated with those of FIGS. 3 and 4 will be omitted.

Referring to FIGS. 14 and 16, an antenna module 300 includes a ground portion 310 and an antenna portion 320. The ground portion 310 includes a lower ground plane 312, a dielectric layer 314 disposed on the lower ground plane 312, and an upper ground plane 316 disposed on the dielectric layer 314. Although not shown, various electronic components such as a chip may be mounted on the upper ground plane 316. In addition, the antenna portion 320 is disposed at an adjoining surface of the ground portion 310, and includes a patch layer 322, a dielectric layer 324 disposed on the patch layer 322, and an antenna layer 326 disposed on the dielectric layer 324. Here, the antenna layer 326 may include a plurality of unit patterns 400 which continuously repeat. The unit pattern may be, for instance, a structure of a Hilbert curve. The Hilbert curve structure will be illustrated in FIG. 19. In the present specification, the Hilbert curve structure and the Hilbert curve fractal structure may be used interchangeably. Further, the antenna layer 326 includes a feed line 410 which is branched off from one end which extends from the plurality of unit patterns 400 and which is connected to the ground portion 310, a signal line 420 which is branched off from the one end which extends from the plurality of unit patterns 400 and which is connected to the ground portion 310, and a dead-end 430 which extends from the plurality of unit patterns 400 to radiate a frequency signal. Here, the plurality of unit patterns 400 may be formed between the feed line 410 and the dead-end 430.

Here, the position and the size of the patch layer 322 may be formed to correspond to the position and the size of the Hilbert curve fractal structure. That is, at least a portion of the Hilbert curve fractal structure may be on the patch layer 322.

Meanwhile, the ground portion 310 is coupled to the antenna portion 320 by capacitive coupling. Therefore, frequency variability of the antenna portion 320 may be facilitated.

To this end, specifically, as shown in FIGS. 14 and 15, the patch layer 322 of the antenna portion 320 may be connected to the lower ground plane 312 of the ground portion 310.

Therefore, the patch layer 322 and the lower ground plane 312 are connected by capacitive coupling, and thus a resonant frequency may be adjustable. Here, according to the connecting position between the patch layer 322 and the lower ground plane 312, a frequency may be variable. That is, as shown in FIG. 15, depending on where the patch layer 322 and the lower ground plane 312 are connected at among P1, P2, and P3, the frequency may vary.

Here, the patch layer 322 and the lower ground plane 312 may be electrically connected. For example, the patch layer 322 may be electrically connected with the lower ground plane 312 through a via 340. As shown in FIG. 16, in the case that the antenna module according to one embodiment of the present invention is mounted on a set printed circuit board (PCB), the patch layer 322 and the lower ground plane 312 may be connected by forming vias 340 at positions on the set PCB corresponding to each of the patch layer 322 and the lower ground plane 312 and disposing an electrode and a resistor 350 at the bottom surface of the set PCB. Here, the vias 340 may be filled with a metal such as copper.

Figure 17:
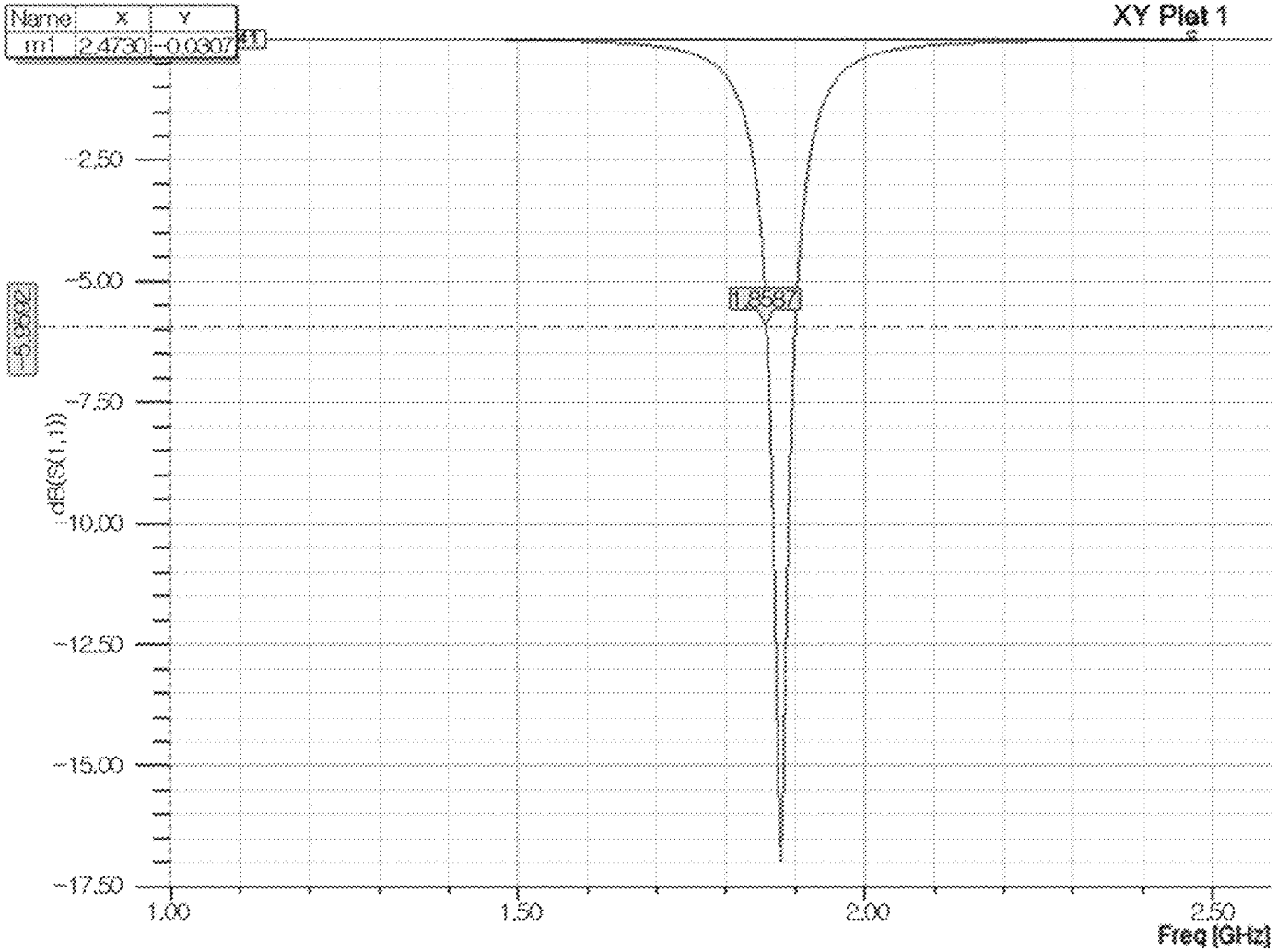
FIG. 17 is an S11 simulation graph in the case that a patch layer and a lower ground plane are connected at P1 of the antenna module of FIG. 15.
Figure 18:
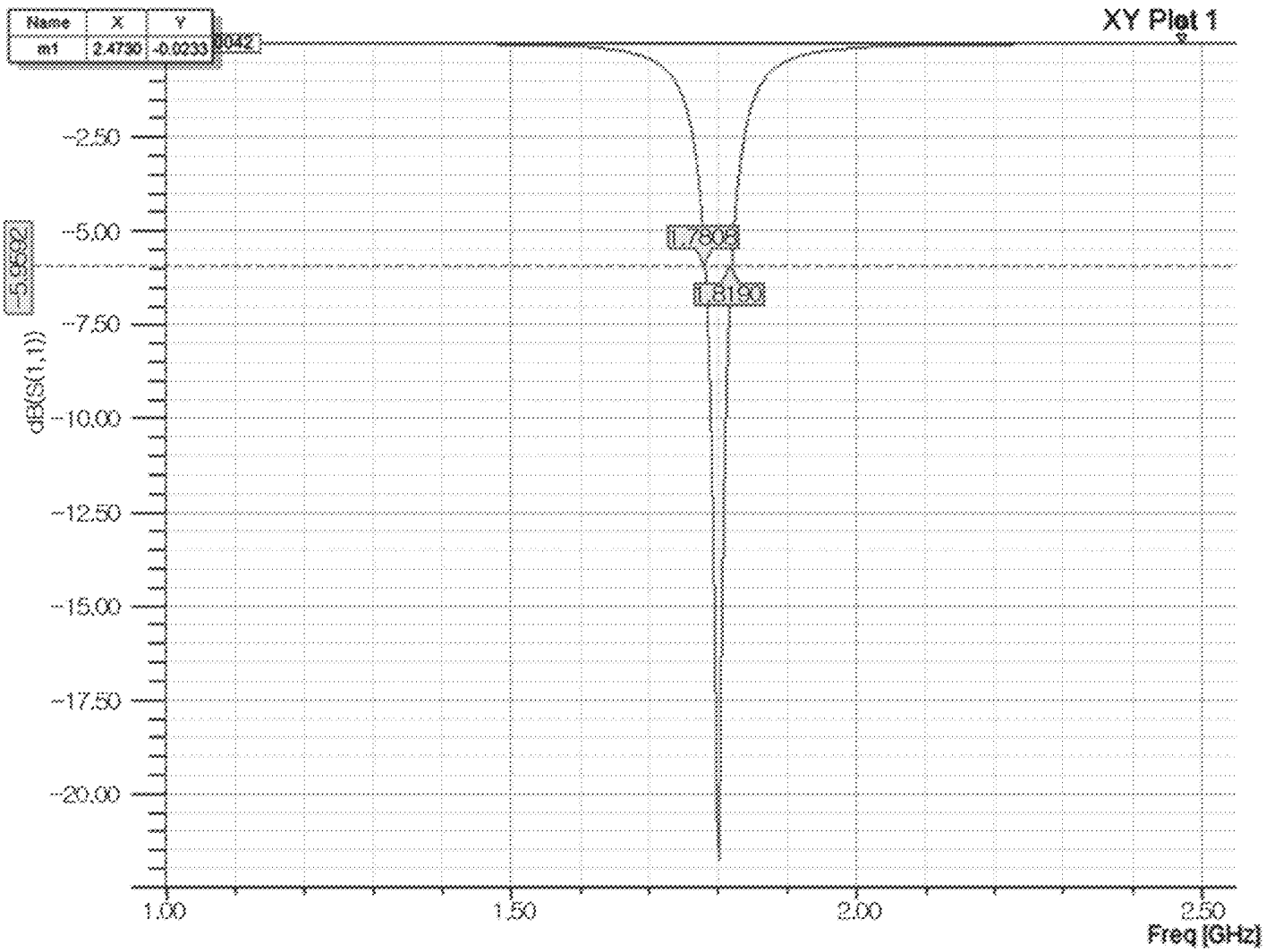
FIG. 18 is an S11 simulation graph in the case that the patch layer and the lower ground plane are connected at P3 of the antenna module of FIG. 15.

FIG. 17 is an S11 simulation graph in the case that the patch layer and the lower ground plane are connected at Pi of the antenna module of FIG. 15, and FIG. 18 is an S11 simulation graph in the case that the patch layer and the lower ground plane are connected at P3 of the antenna module of FIG. 15.

Referring to FIGS. 17 and 18, in the case that the connecting position of the patch layer 322 and the lower ground plane 312 is changed from P1 to P3, the frequency can be seen to deviate by 100 MHz without a gain loss.

According to the embodiments of the present invention, a small-sized antenna module applicable to the ISM band can be obtained. In addition, a frequency variation of the antenna module is facilitated.

While the invention has been shown and described with reference to certain exemplary embodiments thereof, it should be understood by those skilled in the art that various changes in form and details may be made therein without departing from the spirit and scope of the invention as defined by the appended claims.

What is claimed is:

1. An antenna module disposed on a printed circuit board (PCB), comprising:

a ground portion including a lower ground plane and an upper ground plane, and an antenna portion including a patch layer and an antenna layer, wherein the antenna layer includes a plurality of unit patterns disposed on the patch layer, a feed line, and a signal line;

wherein the lower ground plane and the upper ground plane are divided by a dielectric layer, wherein the patch layer and the antenna layer are divided by the dielectric layer, wherein the patch layer and the lower ground plane are connected by the dielectric layer, wherein the patch layer is connected with a first via disposed in the PCB, wherein the lower ground plane is connected with a second via disposed in the PCB, wherein the first via and the second via are electrically connected through an electrode and a register disposed below the PCB, and wherein a resonant frequency is shifted by a connecting position of the patch layer and the lower ground plane.

2. The antenna module of claim 1, wherein the ground portion is coupled to the antenna portion by capacitive coupling.

3. The antenna module of claim 1, wherein the antenna layer is connected to the ground portion.

4. The antenna module of claim 3, wherein the feed line is branched off from one end extending from the plurality of unit patterns and is connected to the ground portion;

wherein the signal line is branched off from the one end extending from the plurality of unit patterns and is connected to the ground portion; and wherein the antenna layer further includes a dead-end configured to extend from the plurality of unit patterns to radiate a frequency signal.

5. The antenna module of claim 4, wherein the plurality of unit patterns is formed between the feed line and the dead-end.

6. The antenna module of claim 4, wherein a shape of the dead-end includes a Hilbert curve.

7. The antenna module of claim 1, wherein an inductive loading is caused by the antenna layer.

8. The antenna module of claim 1, wherein the plurality of unit patterns includes a Hilbert curve structure.

9. An antenna module disposed on a printed circuit board (PCB), comprising:

a ground portion including a lower ground plane and an upper ground plane, and an antenna portion including a patch layer and an antenna layer, wherein the antenna layer includes a plurality of unit patterns disposed on the patch layer, a feed line, and a signal line;

wherein the lower ground plane and the upper ground plane are divided by a dielectric layer, wherein the patch layer and the antenna layer are divided by the dielectric layer, wherein the patch layer and the lower ground plane are connected by the dielectric layer, wherein the patch layer is connected with a first via disposed in the PCB, wherein the lower ground plane is connected with a second via disposed in the PCB.

wherein the first via and the second via are electrically connected, wherein a resonant frequency is shifted by a connecting position of the patch layer and the lower ground plane, and wherein the first via comprises more than two first via units, the second via comprises more than two second via units, a number of the first via units is equal to a number of the second via units, and the connecting position of the patch layer and the lower ground plane is varied based on the connection of the first via and the second via.

* * * * *